US008397690B2

(12) United States Patent
Staley et al.

(10) Patent No.: US 8,397,690 B2
(45) Date of Patent: Mar. 19, 2013

(54) LUBRICATION SYSTEM AND METHOD CONFIGURED FOR SUPPLYING PRESSURIZED OIL TO AN ENGINE

(75) Inventors: David R. Staley, Flushing, MI (US); John C. Schultz, Saline, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 404 days.

(21) Appl. No.: 12/861,418

(22) Filed: Aug. 23, 2010

(65) Prior Publication Data

US 2012/0042846 A1 Feb. 23, 2012

(51) Int. Cl.
*F01M 1/02* (2006.01)

(52) U.S. Cl. ..... 123/196 R; 184/6.5

(58) Field of Classification Search ..... 123/196 R; 184/6.5, 6.6, 6.8

See application file for complete search history.

(56) References Cited

U.S. PATENT DOCUMENTS

| | | | |
|---|---|---|---|
| 6,763,797 | B1 | 7/2004 | Staley et al. |
| 7,281,904 | B2 | 10/2007 | Schultz et al. |
| 7,361,001 | B2 | 4/2008 | Robert |
| 2008/0187446 | A1 | 8/2008 | Staley et al. |

*Primary Examiner* — Noah Kamen
(74) *Attorney, Agent, or Firm* — Quinn Law Group, PLLC

(57) ABSTRACT

A lubrication system includes a rotary pump, an eductor, and a solenoid valve and is configured to provide pressurized oil to an engine. The rotary pump is configured to generate oil flow. A supplemental supply line selectively provides pressurized oil into the eductor. The solenoid valve is movable between a first position and a second position. The solenoid valve supplies a fluid signal that allows pressurized oil to flow from the supplemental supply line and into the eductor when the solenoid valve is in the first position to increase the volume of oil flowing from a sump of the engine into the rotary pump. When the solenoid valve does not supply a fluid signal, pressurized oil is prevented from entering the eductor and the volume of oil flowing from the sump and through the eductor to the rotary pump is not increased.

19 Claims, 6 Drawing Sheets

LUBRICATION SYSTEM AND METHOD CONFIGURED FOR SUPPLYING PRESSURIZED OIL TO AN ENGINE

TECHNICAL FIELD

The invention relates to a lubrication system and method configured for supplying pressurized oil to an engine.

BACKGROUND OF THE INVENTION

Dissolved and entrained air in fluid pumped by a positive displacement pump reduces a pump's output flow capacity resulting in reduced output pressure and unwanted noise due to cavitation. Cavitation occurs when the entrained air collapses or implodes as it passes from a relatively low pressure region of a pump, such as a fluid inlet, to a relatively higher pressure region, such as a discharge or outlet region. The presence of cavitation in a pump has the potential of severely limiting its high speed output flow capability.

SUMMARY OF THE INVENTION

A lubrication system is configured to provide pressurized oil to an engine. The lubrication system includes a rotary pump, an eductor, and a solenoid valve. The rotary pump is configured to provide pressurized oil to the engine. The rotary pump includes a primary input port and a supply port. A primary suction line is fluidly connected to the primary input port and is configured to draw oil from a sump of the engine. The eductor is in fluid communication with the primary suction line such that oil flowing through the primary suction line also flows through the eductor. An oil output line is fluidly connected to the supply port of the rotary pump and is configured to provide the pressurized oil from the rotary pump to the engine. A supplemental supply line selectively fluidly connects the oil output line and the eductor such that pressurized oil selectively flows through the supplemental supply line and into the eductor. The solenoid valve is movable between a first position and a second position. The solenoid valve supplies a fluid signal that allows pressurized oil to act on a flow control valve that in turn routes oil from the supplemental supply line and into the eductor when the solenoid valve is in the first position such that the volume of oil flowing from the sump and through the eductor to the rotary pump is increased. When the solenoid valve does not supply a fluid signal to the flow control valve, pressurized oil is prevented from entering the eductor from the supplemental supply line and the volume of oil flowing from the sump and through the eductor to the rotary pump is not increased.

A method of providing pressurized oil to an engine with a rotary pump and an eductor includes determining an operating characteristic of the engine. A solenoid valve is moved to one of a first position and a second position based on the operating characteristic of the engine. The solenoid valve supplies a fluid signal that allows pressurized oil to flow into an eductor when the solenoid valve is in the first position such that a volume of oil flowing from a sump and through the eductor to a rotary pump is increased. The solenoid valve does not supply a fluid signal and pressurized oil is prevented from entering the eductor when the solenoid valve is in the second position such that the volume of oil flowing from the sump and through the eductor to the rotary pump is not increased.

A lubrication system is configured to provide pressurized oil to an engine. The lubrication system includes a rotary pump, an eductor, and a solenoid valve. The rotary pump is fluidly connected to an eductor such that oil flows from the eductor to the rotary pump. The rotary pump is configured to pressurize the oil. The rotary pump includes a primary input port and a supply port. A primary suction line is fluidly connected to the primary input port and is configured to draw oil from a sump of the engine. The eductor is in fluid communication with the primary suction line such that oil flowing through the primary suction line also flows through the eductor. An oil output line is fluidly connected to the supply port of the rotary pump and is configured to provide the pressurized oil from the rotary pump to the engine. A supplemental supply line selectively fluidly connects the oil output line and the eductor such that pressurized oil selectively flows through the supplemental supply line and into the eductor. The solenoid valve is movable between a first position, a second position, and a third position. The solenoid valve supplies a fluid signal that allows pressurized oil to flow from the supplemental supply line and into the eductor when the solenoid valve is in the first position such that the volume of oil flowing from the sump and through the eductor to the rotary pump is increased. The solenoid valve does not supply a fluid signal and pressurized oil is prevented from entering the eductor from the supplemental supply line when the solenoid valve is in one of the second and the third positions such that the volume of oil flowing from the sump and through the eductor to the rotary pump is not increased. Pressurized oil acts on the rotary pump to maximize displacement of the rotary pump when the solenoid valve is in one of the first and the third positions such that an oil output pressure of the rotary pump is maximized. Pressurized oil acts on the rotary pump to decrease displacement of the rotary pump when the solenoid valve is in the second position such that the oil output pressure of the rotary pump is reduced.

The above features and advantages and other features and advantages of the present invention are readily apparent from the following detailed description of the best mode for carrying out the invention when taken in connection with the accompanying drawings.

DESCRIPTION OF THE PREFERRED EMBODIMENT

Figure 1:
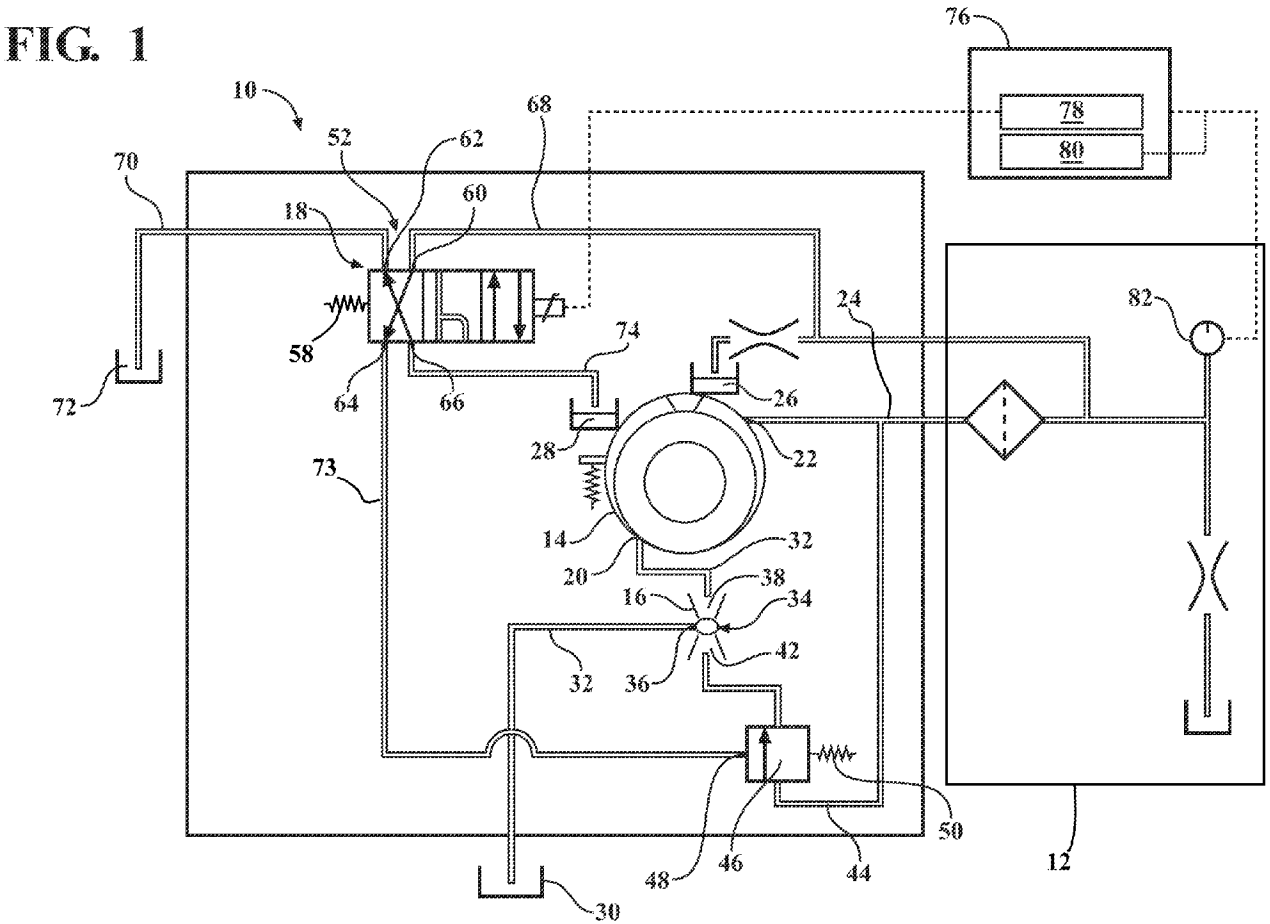
FIG. 1 is a schematic illustration of a lubrication system having a rotary pump, an eductor, and a solenoid valve configured to draw oil from a sump and through the eductor via a primary suction line and into the rotary pump to provide pressurized oil flow to an engine, where the solenoid valve is in a first position.

Referring to the drawings, wherein like reference numbers refer to like components, FIGS. 1-6 illustrate a lubrication system 10 that is configured to provide pressurized oil to an engine 12. The lubrication system 10 includes a rotary pump 14, an eductor 16, a solenoid valve 18, and a flow control valve 46. More specifically, the rotary pump 14 may be either a fixed or a variable displacement pump. The rotary pump 14 includes a primary intake port 20 and a supply port 22. The rotary pump 14 is operatively connected to the engine 12 such that rotation of the engine 12 also rotates the rotary pump 14 to generate oil flow to provide pressurized oil to the engine 12. The primary intake port 20 receives oil from the eductor 16 as the rotary pump 14 rotates. The oil received from the eductor 16 is pressurized by the rotary pump 14. An oil output line 24 is fluidly connected to the supply port 22 of the rotary pump 14 and is configured to provide the pressurized oil from the rotary pump 14 to the engine 12 through an oil output line 24 that leads to the engine 12. The rotary pump 14 also includes a primary actuator 26 and a secondary actuator 28. The primary actuator 26 is fluidly coupled to the oil output line 24 and is configured to be acted upon by pressurized oil from the oil output line 24. The primary actuator 26 is configured to act on an eccentric ring (not shown) within the rotary pump 14 to vary displacement of the rotary pump 14. When only the primary actuator 26 is acting on the eccentric ring, required oil pressure is regulated to a maximum level within the engine 12 while rotational speeds of the engine 12 and the rotary pump 14 will vary throughout their speed range. The secondary actuator 28 is selectively fluidly coupled to the oil output line 24 and is configured to decrease displacement of the rotary pump 14. When pressurized oil is acting on the secondary actuator 28, an additional force is applied to the eccentric ring (not shown) which further reduces pump displacement beyond that generated by the primary actuator 26.

As oil flows through the engine 12, the oil eventually flows downward, into a sump 30. The rotary pump 14 is fluidly connected to the eductor 16 such that oil flows from the eductor 16 to the rotary pump 14. A primary suction line 32 is fluidly connected to the primary input port and is configured to draw oil from the sump 30 of the engine 12. The eductor 16 is in fluid communication with the primary suction line 32 such that oil flowing through the primary suction line 32 also flows through a throat 34 defined within the eductor 16 and into the rotary pump 14 via the primary intake port 20. The eductor 16 may be a jet pump, as known to those skilled in the art. As will be explained in more detail below, the eductor 16 is configured to selectively increase the flow of oil from the sump 30 to the primary intake port 20 via the primary suction line 32. The eductor 16 includes a suction port 36 and an outlet port 38 that each open to the throat 34. The rotary pump 14 rotates to provide suction through the primary intake port 20 from the primary suction line 32. The suction within the primary suction line 32 draws the oil from the sump 30 and into the throat 34 of the eductor 16 via the suction port 36. The oil is drawn through the throat 34 and out of the eductor 16 via the outlet port 38.

Figure 4:
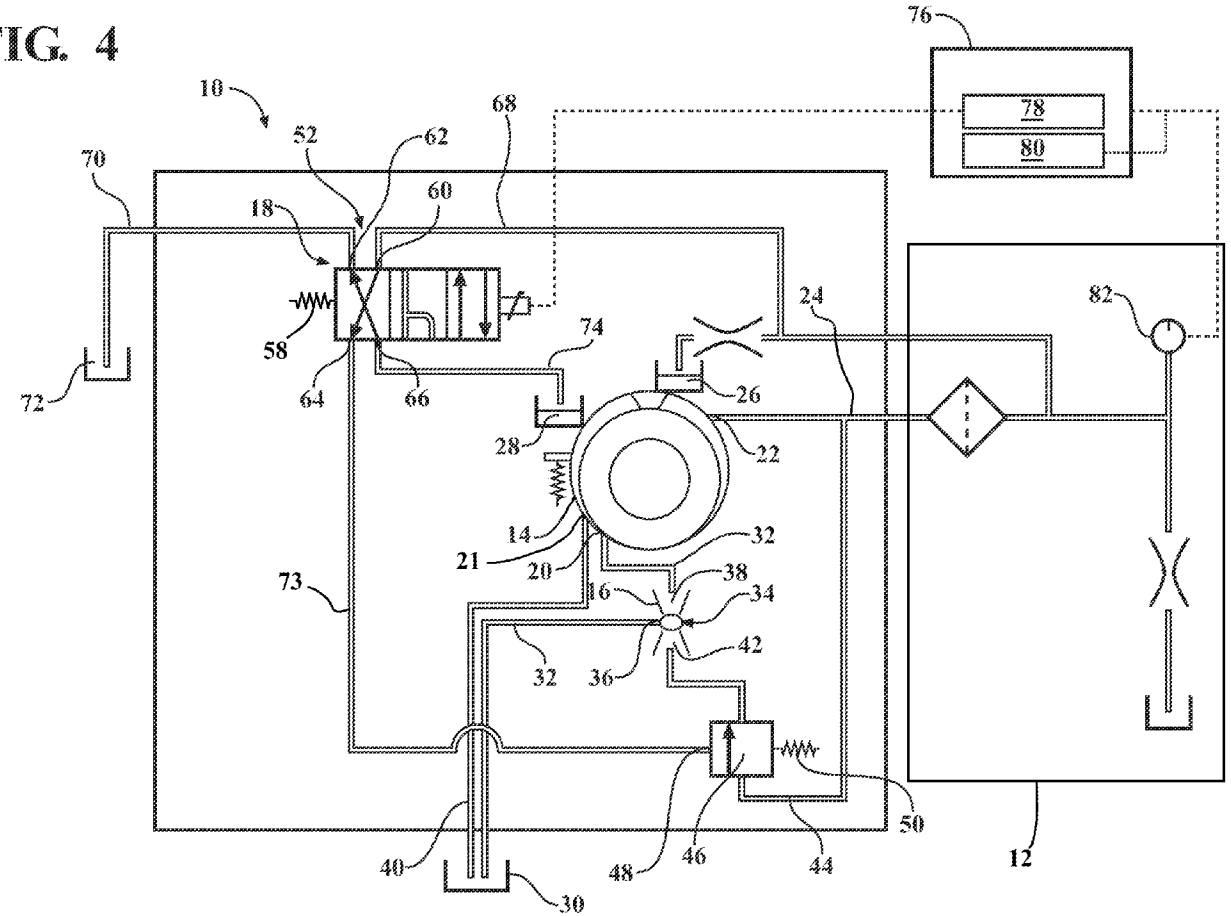
FIG. 4 is a schematic illustration of an alternative embodiment of the lubrication system of FIG. 1 having a secondary suction line in addition to the primary suction line, where the solenoid valve is in the first position.
Figure 5:
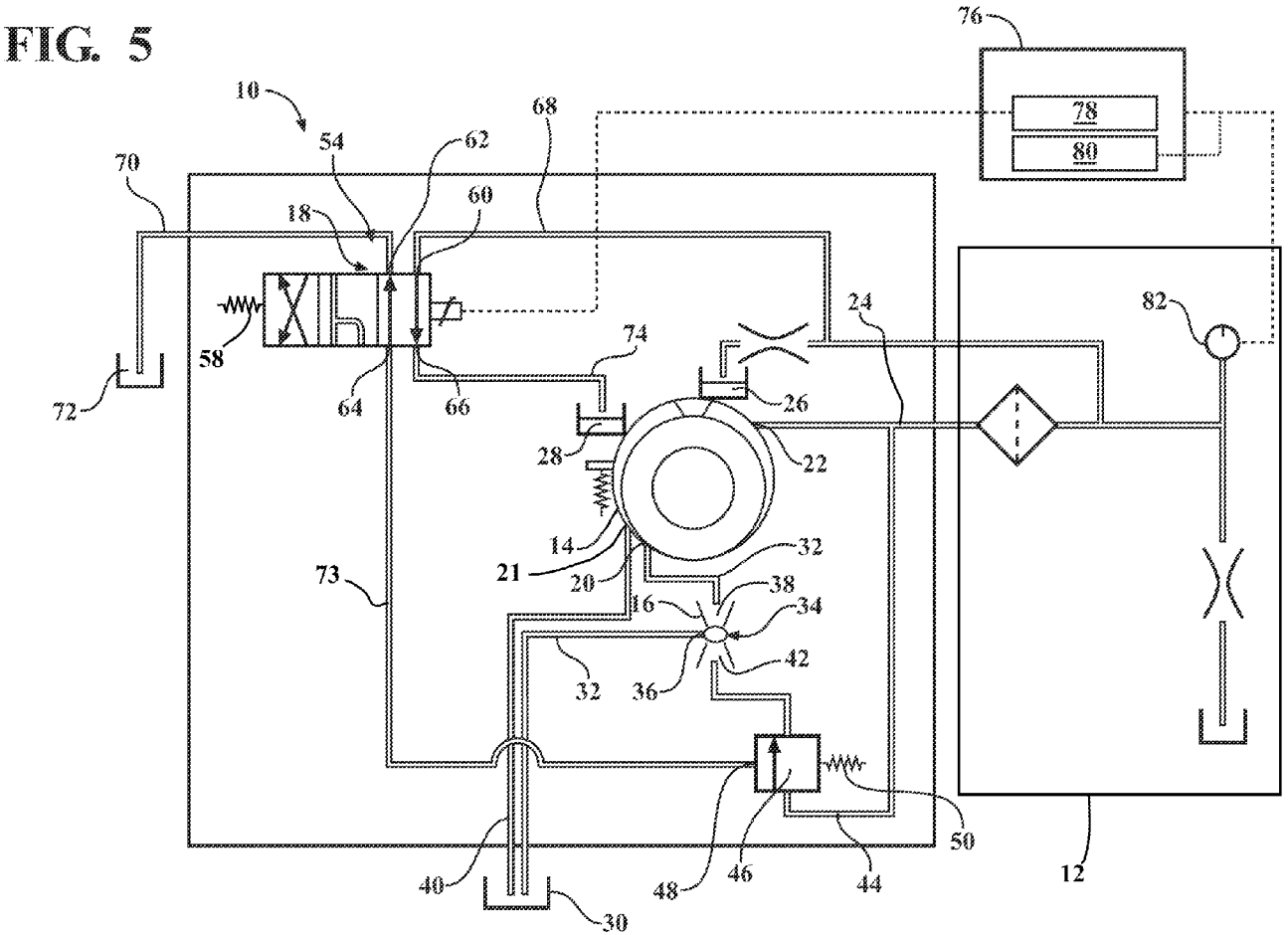
FIG. 5 is a schematic illustration of the lubrication system of FIG. 4 where the solenoid valve is in the second position.
Figure 6:
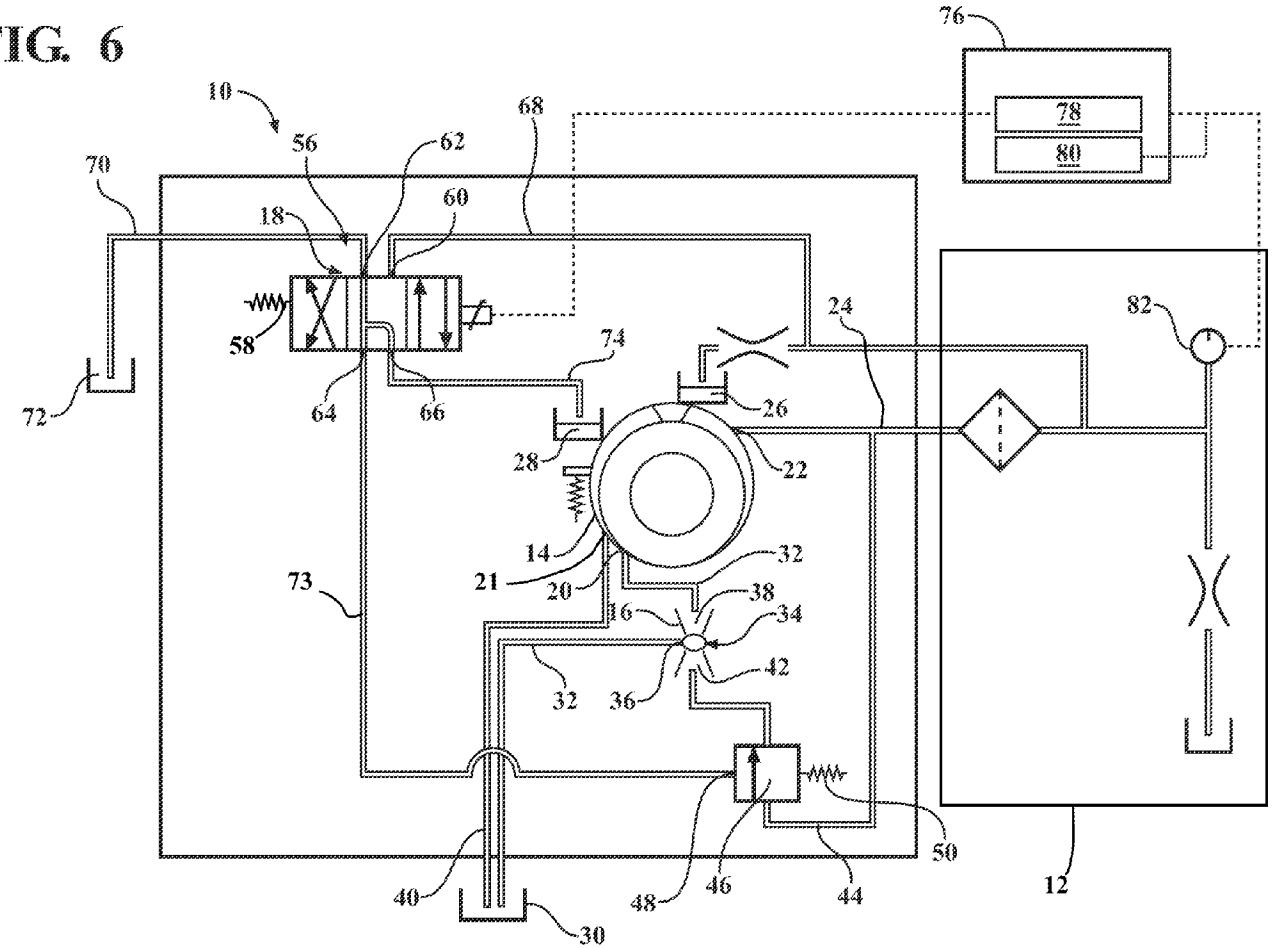
FIG. 6 is a schematic illustration of the lubrication system of FIG. 4 where the solenoid valve is in the third position.

Referring specifically to the embodiment shown in FIGS. 4-6, the lubrication system 10 may also include a secondary suction line 40 that extends directly between the sump 30 and a secondary intake port 21 that also opens to the rotary pump 14. The secondary suction line 40 is configured to provide supplemental flow to the rotary pump 14 via the secondary intake port 21.

Referring again to FIGS. 1-6, the eductor 16 also includes a supplemental converging portion 42 that opens to the flow of oil entering the eductor 16 from the sump 30 via the primary suction line 32. A supplemental supply line 44 selectively fluidly connects the oil output line 24 and the eductor 16 such that pressurized oil selectively flows through the supplemental supply line 44 and into the eductor 16 through the converging portion 42. The pressurized oil flows from the oil output line 24 to the converging portion 42 via the supplemental supply line 44. After entering the eductor 16, the pressurized oil is accelerated to an increased velocity as it exits the converging portion 42 and enters a throat 34. The high velocity oil then enters the oil stream that is provided through the suction port 36 of eductor 16. Due to the high velocity of the oil that was accelerated from the converging portion 42, the velocity of oil in the throat 34 of the eductor 16 is increased. When the velocity of oil increases, the pressure decreases. Thus, the pressure differential across the eductor 16 is increased which induces a larger volume of oil flow from the sump 30 to pass through the eductor 16 than would typically occur without the pressure change caused by the flow through the converging portion 42. The oil velocity is also increased at the outlet port 38 of the eductor 16, further enhancing the flow to the rotary pump 14, via the primary intake port 21.

The flow control valve 46 is fluidly disposed between the eductor 16 and the solenoid valve 18 along the supplemental supply line 44. The flow control valve 46 includes a pilot 48 and the flow control valve 46 opens and closes in response to a fluid signal applied to the pilot 48 from the solenoid valve 18 via the valve activation line 73. Therefore, the flow control valve 46 is configured to receive the fluid signal from the solenoid valve 18. The flow control valve 46 is configured to open in response to receiving the fluid signal from the solenoid valve 18 such that pressurized oil is allowed to flow from the supplemental supply line 44 through the flow control valve 46 and into the eductor 16 via the converging portion 42 when the flow control valve 46 is opened. The flow control valve 46 is biased to be closed, via a first spring 50, in the absence of the fluid signal. Therefore, the flow control valve 46 closes in response to the absence of the fluid signal from the solenoid valve 18 such that pressurized oil is prevented from flowing from the supplemental supply line 44 through the flow control valve 46 and into the eductor 16.

The solenoid valve 18 is moveable between a first position 52 (FIGS. 1 and 4), a second position 54 (FIGS. 2 and 5), and a third position 56 (FIGS. 3 and 6) in response to a corresponding signal. The solenoid valve 18 may be an electric solenoid valve 18 valve that is biased to the first position 52 via a second spring 58. Therefore, in the absence of a signal, the solenoid valve 18 is in the first position 52. In the event the solenoid valve 18 does not respond to a signal to move the solenoid valve 18 to one of the second or third positions 54, 56, the solenoid valve's 18 default position is the first position 52. The solenoid valve 18 includes four ports 60, 62, 64, 66, i.e., a first port 60, a second port 62, a third port 64, and a fourth port 66. Each of the four ports 60, 62, 64, 66 is in fluid communication with the solenoid valve 18. A secondary supply line 68 extends between the first port 60 and the oil output line 24 such that pressurized oil flows to the second port 62 via the secondary supply line 68. A ventilation line 70 extends between the second port 62 and atmosphere 72 to provide ventilation of the second port 62 to atmosphere 72. A valve activation line 73 extends between the third port 64 and the flow control valve 46 such that the flow control valve 46 is in fluid communication with the third port 64. A second actuator supply line 74 extends between the fourth port 66 and the secondary actuator 28 such that the secondary actuator 28 is in fluid communication with the fourth port 66.

Referring specifically to FIGS. 1 and 4, when the solenoid valve 18 is in the first position 52, the first port 60 is fluidly connected to the third port 64 and the fourth port 66 is fluidly connected to the second port 62. The pressurized oil flows from the secondary supply line 68 and into the solenoid valve 18 through the first port 60. The pressurized oil then flows out of the solenoid valve 18 through the third port 64 and into the valve activation line 73. The pressurized oil then flows through the valve activation line 73 to provide a fluid signal to the pilot 48 of the flow control valve 46 such that the flow control valve 46 opens, as described above. More specifically, the solenoid valve 18 supplies a fluid signal that allows pressurized oil to flow from the supplemental supply line 44 and into the eductor 16 when the solenoid valve 18 is in the first position 52 such that the volume of oil flowing from the sump 30 and through the eductor 16 to the rotary pump 14 is increased. Also, since the second port 62 is normally open to atmosphere 72 and the fourth port 66 is fluidly connected to the second port 62 when the solenoid valve 18 is in the first position 52, the fourth port 66 and the corresponding second actuator supply line 74 are also open to atmosphere 72 such that the second actuator supply line 74 is vented to atmosphere 72 and no oil is acting on the second actuator 28. Additionally, since no pressurized oil is acting on the secondary actuator 28, the primary actuator 26 acts on the rotary pump 14 such that an oil output pressure of the rotary pump 14 is regulated to a maximum level.

Figure 2:
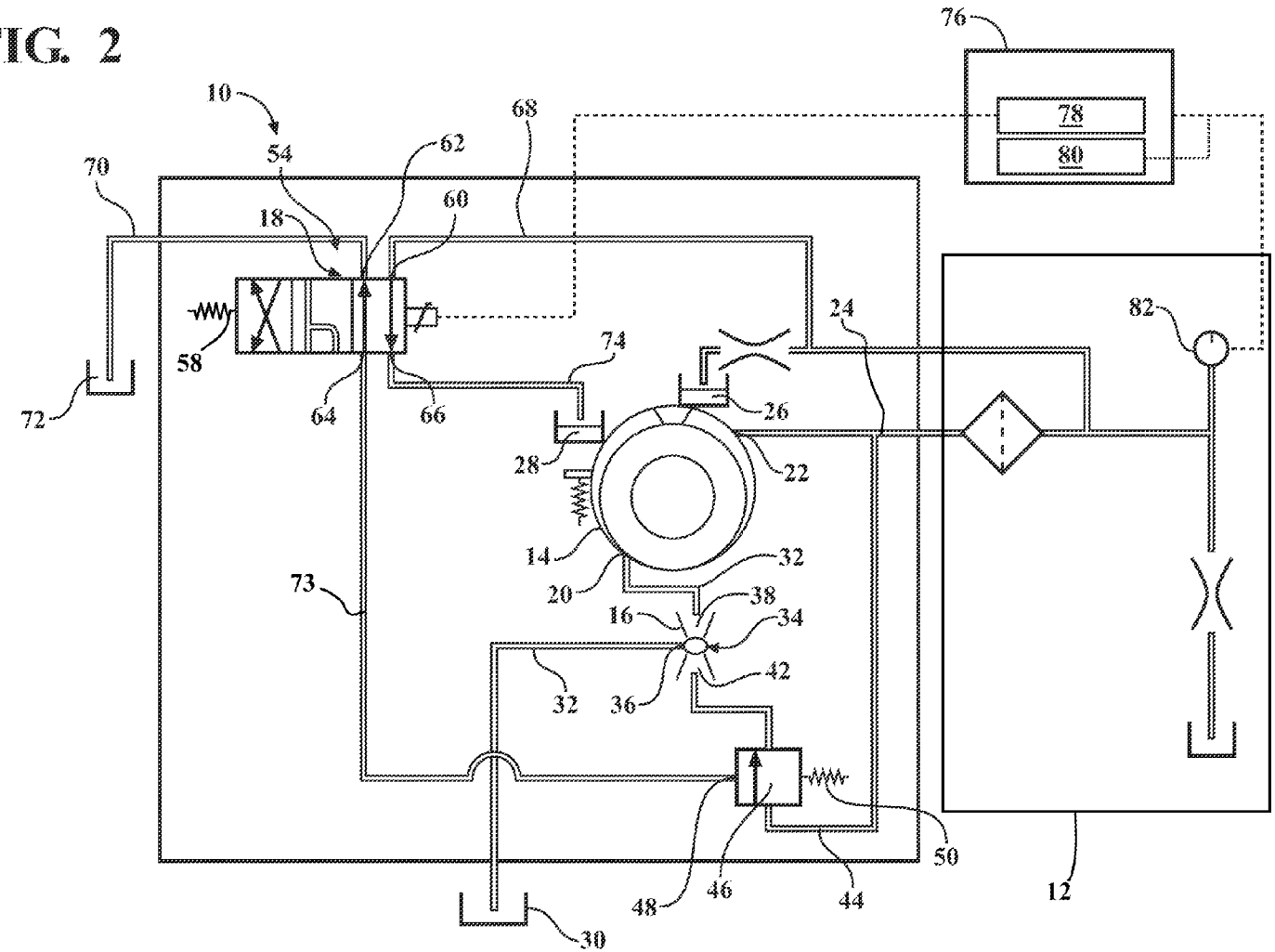
FIG. 2 is a schematic illustration of the lubrication system of FIG. 1 where the solenoid valve is in a second position.

Referring now to FIGS. 2 and 5, when the solenoid valve 18 is in the second position 54, the third port 64 is fluidly connected to the second port 62 and the first port 60 is fluidly connected to the fourth port 66. Accordingly, the valve activation line 73 is vented to atmosphere 72 such that no signal is provided to act on the pilot 48 of the flow control valve 46. Therefore, the flow control valve 46 remains closed, as described above. More specifically, the solenoid valve 18 does not supply a fluid signal and pressurized oil is prevented from entering the eductor 16 from the supplemental supply line 44 when the solenoid valve 18 is in the second position 54 such that the volume of oil flowing from the sump 30 and through the eductor 16 to the rotary pump 14 is not increased. Additionally, the pressurized oil from the secondary supply line 68 flows into the solenoid valve 18 through the first port 60 and out of the solenoid valve 18 and into the second actuator supply line 74 through the fourth port 66 such that the pressurized fluid acts on the secondary actuator 28 to vary the displacement of the rotary pump 14 such that the oil output pressure of the rotary pump 14 is regulated to a minimum level.

Figure 3:
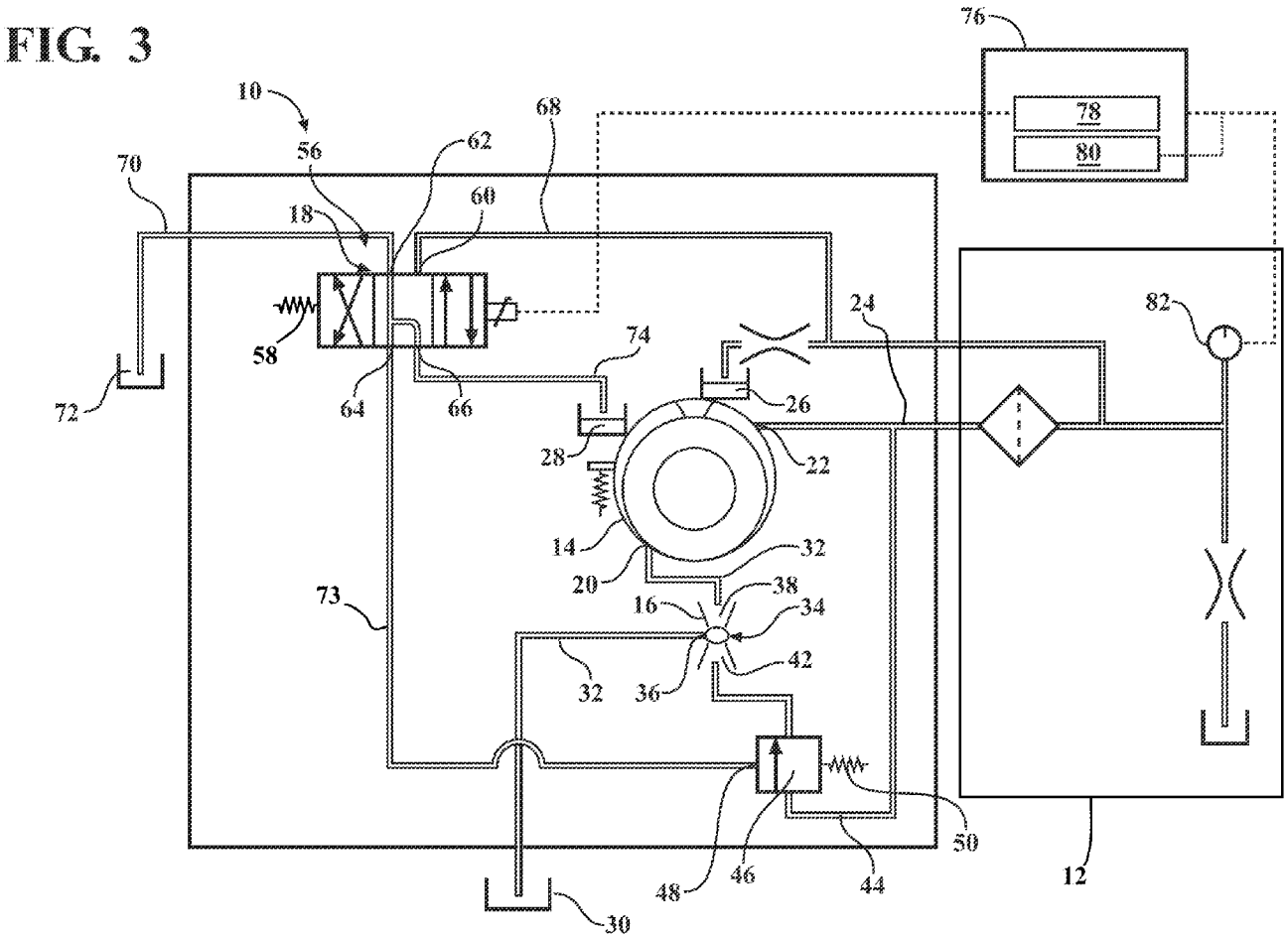
FIG. 3 is a schematic illustration of the lubrication system of FIG. 1 where the solenoid valve is in a third position.

Referring to FIGS. 3 and 6, when the solenoid valve 18 is in the third position 56, the second, third, and fourth ports 62, 64, 66 are fluidly connected to one another. When the solenoid valve 18 is in the third position 56, the valve activation line 73 and the second actuator line are vented to atmosphere 72 such that the system is at equilibrium and no oil is acting on the pilot 48 of the flow control valve 46 or on the secondary actuator 28. This means that the solenoid valve 18 does not supply a fluid signal to the flow control valve 46 from the valve activation line 73 when the solenoid valve 18 is in the third position 56 such that the volume of oil flowing from the sump 30 and through the eductor 16 to the rotary pump 14 is not increased. Additionally, since no pressurized oil is acting on the secondary actuator 28, the primary actuator 26 acts on the rotary pump 14 such that the oil output pressure of the rotary pump 14 is regulated to a maximum level.

The lubrication system 10 also includes a computer 76 having controls 78 and diagnostics 80. The computer 76 is operatively connected to the solenoid valve 18 and is configured to monitor at least one operating characteristic of the engine 12. One or more sensors 82 are operatively disposed between the engine 12 and the computer 76 and are configured to detect one or more of the operating characteristics of the engine 12. The sensors 82 may include an oil pressure sensor, oil temperature sensor, engine speed sensor, engine load sensor, etc. The oil pressure sensor is configured for determining pressure of the oil inside of the engine 12 during engine 12 operation. The oil temperature sensor is configured for determining the temperature of the oil within the engine 12. The engine speed sensor is configured for determining the rotational speed of the engine 12 in revolutions per minute (RPM). The engine load is a measure of how much load is being placed on the engine 12 for power, i.e., brake, operating the radio, operating the A/C system, operating the windshield wipers, etc. Each of these sensors 82 provides an input to the computer 76. Based on the operating characteristics received from one or more of these sensors 82, the controls 78 of the computer 76 determines whether oil flow through the rotary pump 14 needs to change. The controls 78 send a signal to the solenoid valve 18 to move the solenoid valve 18 to the first, second, or third position 52, 54, 56 based on the operating characteristic of the engine 12. For example, referring again to FIGS. 1 and 4, during high speed operation of the engine 12, the operating characteristic, may be engine speed. When engine speeds are greater than approximately 5,000 RPM, rotary pumps 14 typically experience significant flow loss due to cavitation. To counteract this flow loss as the pressure of the pressurized oil exiting the supply port 22 decreases, the controls 78 of the computer 76 signal the solenoid valve 18 to move to the first position 52 by deenergizing the solenoid valve 18. Therefore, as described above, in the absence of a signal, the solenoid valve 18 automatically moves to the first position 52. In the first position 52, the pilot 48 of the flow control valve 46 is activated and the flow control valve 46 opens, boosting volume of oil flowing through the eductor 16 and into the rotary pump 14. The increased volume of oil flowing through the eductor 16 and into the rotary pump 14 relieves cavitation.

Additionally, when the solenoid valve 18 is in the first position 52, the controls 78 may proportionally control the flow of pressurized oil through the eductor 16 by modulating or pulsing the signal to the solenoid valve 18 to, in turn, modulate the fluid signal acting on the pilot 48 of the flow control valve 46. The solenoid valve 18 is configured to provide a modulated fluid signal at the first position 52. The modulated fluid signal acts on the flow control valve 46 such that the flow control valve 46 opens an amount proportional to the modulated fluid signal and pressurized oil is allowed to flow from the supplemental supply line 44 through the flow control valve 46 and into the eductor 16 at a volume that is also proportional to the modulated fluid signal. The proportional control of the flow control valve 46, in turn, limits the amount of high pressure oil that flows through the flow control valve 46 and into the supplemental inlet port. By limiting the amount of high pressure oil that flows through the flow control valve 46 and into the eductor 16, proportional control of the velocity (and pressure) of the oil flowing through the eductor 16 can be achieved. More specifically, the velocity of the oil from the sump 30 and through the eductor 16 can be proportionally controlled to be between the velocity of the oil when the flow control valve 46 is fully open and the velocity of the oil when the flow control valve 46 is completely closed.

Referring again to FIGS. 2 and 5, during low speed operation of the engine 12, the operating characteristic of the engine 12 speed is less than approximately 3000 RPM. During low speed operation of the engine 12, the rotary pump 14 typically experiences an oil over-pressure condition. To counteract the excess engine 12 oil pressure, when an over-pressure condition exists, the controls 78 signal the solenoid valve 18 to move the solenoid valve 18 to the second position 54. In the second position 54, as explained above, the pilot 48 of the flow control valve 46 is not activated and the flow control valve 46 is closed. Therefore, flow through the eductor 16 is not boosted. Additionally, the high pressure oil flows through the second actuator supply line 74 and acts on the secondary actuator 28 such that the secondary actuator 28 varies the displacement of the rotary pump 14 to control the oil outlet pressure of the rotary pump 14 to an optimum level.

Referring to FIGS. 3 and 6, during a mid-range operating speed of the engine 12, the operating characteristic of the engine 12 speed is between approximately 3,000 RPM and 5,000 RPM. During the mid-range operating speed, the controls 78 signal the solenoid valve 18 to move the solenoid valve 18 to the third position 56. In the third position 56, as explained above, the system is in equilibrium such that no oil pressure is acting on the pilot 48 of the flow control valve 46 or the secondary actuator 28. Accordingly, there is no boost to the oil entering the rotary pump 14 and the secondary actuator 28 does not vary the displacement of the rotary engine 12. The controls 78 are configured to modulate or pulse the signal to the solenoid valve 18 to achieve the third position 56.

While the best mode for carrying out the invention has been described in detail, those familiar with the art to which this invention relates will recognize various alternative designs and embodiments for practicing the invention within the scope of the appended claims.

The invention claimed is:

1. A lubrication system configured to provide pressurized oil to an engine, the lubrication system comprising:

a rotary pump fluidly connected to an eductor such that oil flows from the eductor to the rotary pump;

wherein the rotary pump is configured to supply pressurized oil to the engine;

wherein the rotary pump includes a primary input port and a supply port;

a primary suction line fluidly connected to the primary input port and configured to draw oil from a sump of the engine;

an eductor in fluid communication with the primary suction line such that oil flowing through the primary suction line also flows through the eductor;

an oil output line fluidly connected to the supply port of the rotary pump and configured to provide the pressurized oil from the rotary pump to the engine;

a supplemental supply line selectively fluidly connecting the oil output line and the eductor such that pressurized oil selectively flows through the supplemental supply line and into the eductor;

a solenoid valve movable between a first position and a second position;

wherein the solenoid valve supplies a fluid signal that allows pressurized oil to flow from the supplemental supply line and into the eductor when the solenoid valve is in the first position such that the volume of oil flowing from the sump and through the eductor to the rotary pump is increased;

wherein the solenoid valve does not supply a fluid signal and pressurized oil is prevented from entering the eductor from the supplemental supply line when the solenoid valve is in the second position such that the volume of oil flowing from the sump and through the eductor to the rotary pump is not increased.

2. The lubrication system, as set forth in claim 1, further comprising a flow control valve fluidly disposed between the eductor and the solenoid valve such that the flow control valve is configured to receive the fluid signal from the solenoid valve;

wherein the flow control valve is configured to open in response to receiving the fluid signal from the solenoid valve such that pressurized oil is allowed to flow from the supplemental supply line through the flow control valve and into the eductor; and wherein the flow control valve is configured to close in response to the absence of the fluid signal from the solenoid valve such that pressurized oil is prevented from flowing from the supplemental supply line through the flow control valve and into the eductor.

3. The lubrication system, as set forth in claim 2, wherein the rotary pump is a variable displacement pump.

4. The lubrication system, as set forth in claim 3, wherein the variable displacement pump includes:

a primary actuator fluidly coupled to the oil output line and configured to be continuously acted upon by pressurized oil from the oil output line such that the primary actuator acts to maximize displacement of the rotary pump;

a secondary actuator selectively fluidly coupled to the oil output line and configured to be selectively acted upon by pressurized oil from the oil output line that is at a pressure greater than a pressure of the pressurized oil acting on the primary actuator such that the secondary actuator overcomes the primary actuator to decrease the displacement of the rotary pump and reduce the oil output pressure of the rotary pump.

5. The lubrication system, as set forth in claim 4, wherein the flow control valve includes a pilot and the flow control valve opens and closes in response to applying the pressure signal via the valve actuation line.

6. The lubrication system, as set forth in claim 4, wherein the solenoid valve is configured to provide a modulated fluid signal to act on the flow control valve such that the flow control valve opens an amount proportional to the modulated fluid signal and pressurized oil is allowed to flow from the supplemental supply line through the flow control valve and into the eductor at a volume that is also proportional to the modulated fluid signal.

7. The lubrication system, as set forth in claim 4, wherein the solenoid valve includes a first port, a second port, a third port, and a fourth port, the lubrication system further comprising:

a secondary supply line extending between the first port and the oil output line such that pressurized oil flows to the secondary port via the secondary supply line;

a ventilation line extending between the second port and atmosphere to provide ventilation of the second port to atmosphere;

a valve activation line extending between the third port and the flow control valve such that the flow control valve is in fluid communication with the third port; and a second actuator supply line extending between the fourth port and the secondary actuator such that the secondary actuator is in fluid communication with the fourth port.

8. The lubrication system, as set forth in claim 7, wherein when the solenoid valve is in the first position, the first port is fluidly connected to the third port such that pressurized oil flows from the secondary supply line and into the solenoid valve through the first port and the pressurized oil flows out of the solenoid valve through the third port and into the valve activation line to provide a fluid signal to the pilot of the flow control valve such that the flow control valve opens; and wherein the fourth port is fluidly connected to the second port such that the second actuator supply line is vented to atmosphere and no oil is acting on the second actuator.

9. The lubrication system, as set forth in claim 7, wherein when the solenoid valve is in the second position, the third port is fluidly connected to the second port such that the valve activation line is vented to atmosphere and no fluid signal is acting on the flow control valve to keep the flow control closed; and wherein the first port is fluidly connected to the fourth port such that the pressurized oil from the secondary supply line flows into the solenoid valve through the first port and out of the solenoid valve and into the second actuator supply line through the fourth port such that the pressurized fluid acts on the secondary actuator to decrease the displacement of the rotary pump and reduce the oil output pressure of the rotary pump.

10. The lubrication system, as set forth in claim 7, wherein the solenoid valve is movable to a third position;

wherein the solenoid valve does not supply a fluid signal to the flow control valve from the valve activation line when the solenoid valve is in the third position such that the volume of oil flowing from the sump and through the eductor to the rotary pump is not increased.

11. The lubrication system, as set forth in claim 7, wherein when the solenoid valve is in the third position, the second, third, and fourth ports are fluidly connected to one another such that the valve activation line and the second actuator line are vented to atmosphere and no oil is acting on the flow control valve and the secondary actuator.

12. The lubrication system, as set forth in claim 11, further comprising a computer operatively connected to the solenoid valve and configured to monitor at least one operating characteristic of the engine;

wherein the controls signals the solenoid valve to move to the first position when the at least one operating characteristic is equivalent to the engine operating at a high speed operating characteristic of greater than approximately 5,000 RPM;

wherein the controls signals the solenoid valve to move to the second position when the at least one operating characteristic is equivalent to the engine operating at a low speed operating characteristic of less than approximately 3,000 RPM;

wherein the controls signals the solenoid valve to move to the third position when the at least one operating characteristic is equivalent to the engine operating at a mid-range speed operating characteristic of between approximately 3,000 RPM and 5,000 RPM.

13. The lubrication system, as set forth in claim 1, wherein the rotary pump further includes a primary input port and the lubrication system further comprises a secondary suction line that extends between the sump and the secondary intake port;

wherein the secondary suction line is configured to supplement flow through the primary suction line to the rotary pump by providing a supplemental flow of oil from the sump to the secondary intake port.

14. A method of providing pressurized oil to an engine with a rotary pump and an eductor, the method comprising:

determining an operating characteristic of the engine;

moving a solenoid valve to one of a first position and a second position based on the operating characteristic of the engine;

wherein the solenoid valve supplies a fluid signal that allows pressurized oil to flow into an eductor when the solenoid valve is in the first position such that a volume of oil flowing from a sump and through the eductor to a rotary pump is increased;

wherein the solenoid valve does not supply a fluid signal and pressurized oil is prevented from entering the eductor when the solenoid valve is in the second position such that the volume of oil flowing from the sump and through the eductor to the rotary pump is not increased.

15. A method, as set forth in claim 14, wherein the solenoid valve moves to the first position when the operating characteristic is a high speed operating characteristic of greater than approximately 5,000 RPM; and wherein the solenoid valve moves to the second position when the operating characteristic is a low speed operating characteristic of less than approximately 3,000 RPM.

16. A method, as set forth in claim 15, wherein the wherein the solenoid valve acts upon the rotary pump to decrease displacement of the rotary pump when the solenoid valve is in the second position such that the oil output pressure of the rotary pump is reduced.

17. A method, as set forth in claim 16, wherein moving a solenoid valve is further defined as moving a solenoid valve to one of a first position, a second position, and a third position based on the operating characteristic of the engine; and wherein the solenoid valve does not supply a fluid signal and pressurized oil is prevented from entering the eductor when the solenoid valve is in the third position such that the volume of oil flowing from the sump and through the eductor to the rotary pump is not increased.

18. A method, as set forth in claim 17, wherein the solenoid valve moves to the third position when the operating characteristic is a mid-range speed operating characteristic of between approximately 3,000 RPM and 5,000 RPM.

19. A lubrication system configured to provide pressurized oil to an engine, the lubrication system comprising:

a rotary pump fluidly connected to an eductor such that oil flows from the eductor to the rotary pump;

wherein the rotary pump is configured to pressurize the oil;

wherein the rotary pump includes a primary input port and a supply port;

a primary suction line fluidly connected to the primary input port and configured to draw oil from a sump of the engine;

an eductor in fluid communication with the primary suction line such that oil flowing through the primary suction line also flows through the eductor;

an oil output line fluidly connected to the supply port of the rotary pump and configured to provide the pressurized oil from the rotary pump to the engine;

a supplemental supply line selectively fluidly connecting the oil output line and the eductor such that pressurized oil selectively flows through the supplemental supply line and into the eductor;

a solenoid valve movable between a first position, a second position, and a third position;

wherein the solenoid valve supplies a fluid signal that allows pressurized oil to flow from the supplemental supply line and into the eductor when the solenoid valve is in the first position such that the volume of oil flowing from the sump and through the eductor to the rotary pump is increased;

wherein the solenoid valve does not supply a fluid signal and pressurized oil is prevented from entering the eductor from the supplemental supply line when the solenoid valve is in one of the second and the third positions such that the volume of oil flowing from the sump and through the eductor to the rotary pump is not increased;

wherein pressurized oil acts on the rotary pump to maximize displacement of the rotary pump when the solenoid valve is in one of the first and the third positions such that the oil output pressure of the rotary pump is maximized; and wherein pressurized oil acts on the rotary pump to decrease displacement of the rotary pump when the solenoid valve is in the second position such that the oil output pressure of the rotary pump is reduced.

* * * * *